US006230880B1

(12) United States Patent
Marco et al.

(10) Patent No.: US 6,230,880 B1
(45) Date of Patent: May 15, 2001

(54) LABEL PANEL CONTAINER CARRIER

(75) Inventors: Leslie S. Marco, Bloomingdale; James A. Broskow, Buffalo Grove; Robert Olsen, Medinah, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/376,441

(22) Filed: Aug. 18, 1999

(51) Int. Cl.[7] ..... B65D 71/50
(52) U.S. Cl. ..... 206/150; 206/459.5
(58) Field of Search ..... 206/147, 150, 206/151, 199, 232, 459.5

(56) References Cited

U.S. PATENT DOCUMENTS

| | | | |
|---|---|---|---|
| 3,307,321 | 3/1967 | Beart . | |
| 3,432,202 | 3/1969 | Ebelhardt . | |
| 4,545,480 | 10/1985 | Klygis . | |
| 4,546,876 * | 10/1985 | Rhoads | 206/150 |
| 4,782,955 | 11/1988 | Weaver et al. . | |
| 5,018,620 | 5/1991 | Marco et al. . | |
| 5,038,928 | 8/1991 | Marco et al. . | |
| 5,072,829 | 12/1991 | Marco et al. . | |
| 5,115,910 * | 5/1992 | Klygis et al. | 206/150 |
| 5,255,780 | 10/1993 | Olsen . | |
| 5,261,530 | 11/1993 | Marco . | |
| 5,651,453 | 7/1997 | Olsen . | |
| 5,653,334 | 8/1997 | Marco . | |

* cited by examiner

*Primary Examiner*—Jim Foster
(74) *Attorney, Agent, or Firm*—Pauley Petersen Kinne & Fejer

(57) ABSTRACT

This invention relates to a package of a plurality of containers unitized with a flexible carrier. The carrier is constructed from a plastic planar sheet having a plurality of container receiving openings arranged in longitudinal rows and transverse ranks. A panel extends from a longitudinal edge of the planar sheet that is arranged to either remain flat and tight with respect to the package or, alternatively, follow an external contour of the package.

15 Claims, 8 Drawing Sheets

LABEL PANEL CONTAINER CARRIER

BACKGROUND OF THE INVENTION

1. Field of the Invention

This invention relates to a carrier for unitizing containers having a plurality of container receiving openings configured to allow an integral panel to remain in one of a flat and tight position or a contoured and tight position with respect to the containers.

2. Description of Prior Art

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, when used alone has little or no advertising or promotional printing space. Conversely, the box carrier generally has a relatively large amount of area for promotional graphics. Disadvantageously, the box carrier requires a relatively large amount of material, permits bottles to fall out if it is not maintained in an upright position, and usually shrouds much of the actual containers. Therefore, there is a need for a package that incorporates the stability and economy of a ring carrier and the promotional area of a box carrier.

SUMMARY OF THE INVENTION

It is one object of this invention to provide a container carrier that is rim-applied to containers and provides a panel for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is yet another object of this invention to provide a panel that can support the weight of a package of containers if inadvertently used as a handle for the package.

It is still another object of one preferred embodiment of this invention to provide a container carrier that maintains a panel in a flat and tight configuration with respect to the unitized containers.

It is yet another object of another preferred embodiment of this invention to provide a panel on a container carrier that does not protrude from a package of containers and instead follows an external contour of the package.

A carrier according to this invention carries a plurality of containers such as cans. The carrier comprises a planar, preferably plastic., sheet formed with a plurality of container receiving openings. The container receiving openings are formed in longitudinal rows and transverse ranks.

According to one preferred embodiment of this invention, the containers are positioned in each container receiving opening to form a package having a panel that is flat, tight and parallel with respect to the containers and prominent with respect to the package. Such a configuration of the panel results in a package of containers having a prominent display area or "billboard" for advertising, information, graphics and other marketing material.

According to another preferred embodiment of this invention, the containers are positioned in each container receiving opening to form a package having a contour panel that follows an external contour of the package. Such a configuration of the contour panel results in a package of containers having prominent display area without the contour panel protruding or otherwise interfering with adjacent packages.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
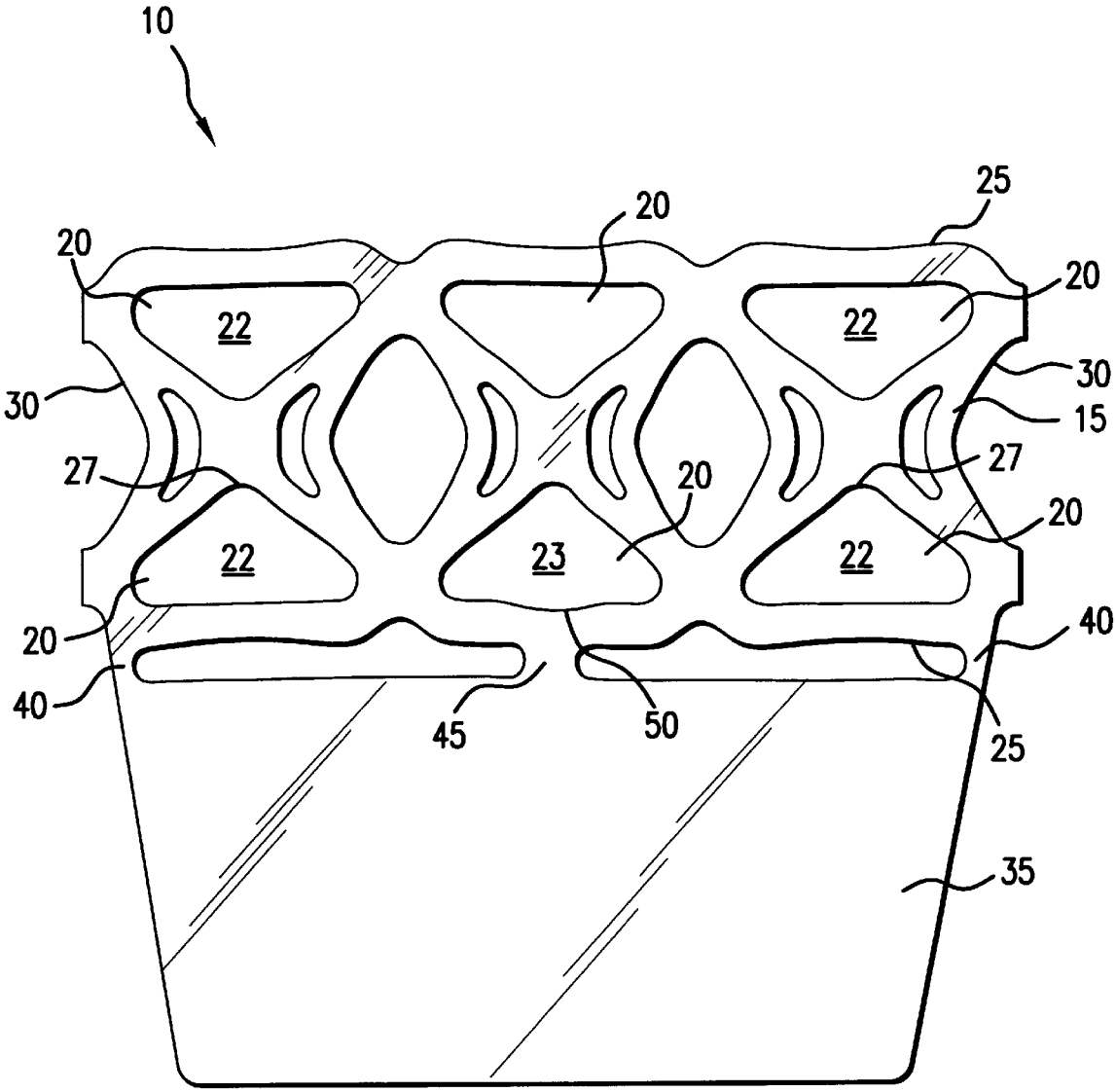
FIG. 1 is a top view of a carrier for holding six containers according to one preferred embodiment of this invention.
Figure 2:
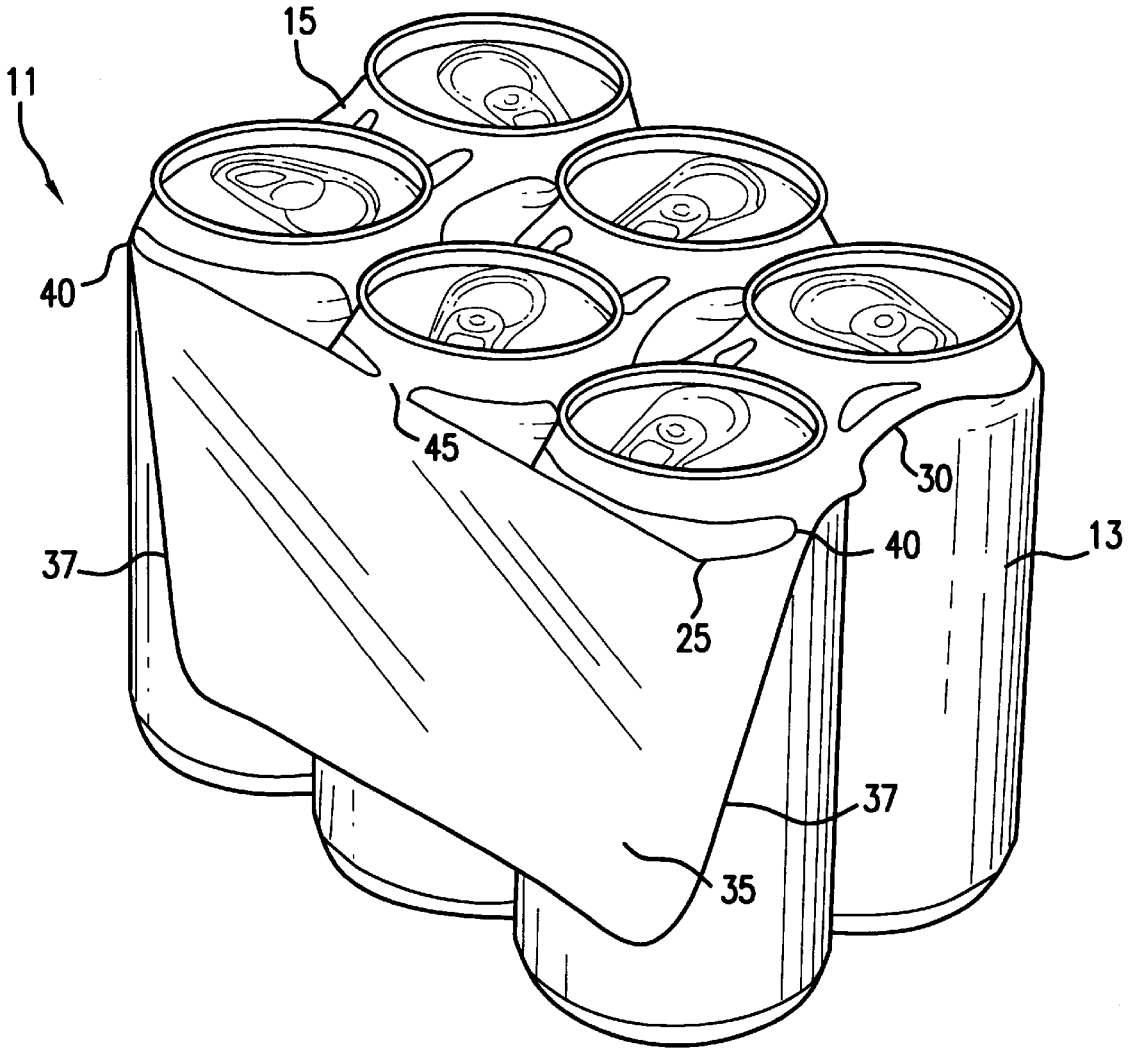
FIG. 2 is a perspective view of a package of containers using a carrier according to one preferred embodiment of this invention.
Figure 7:
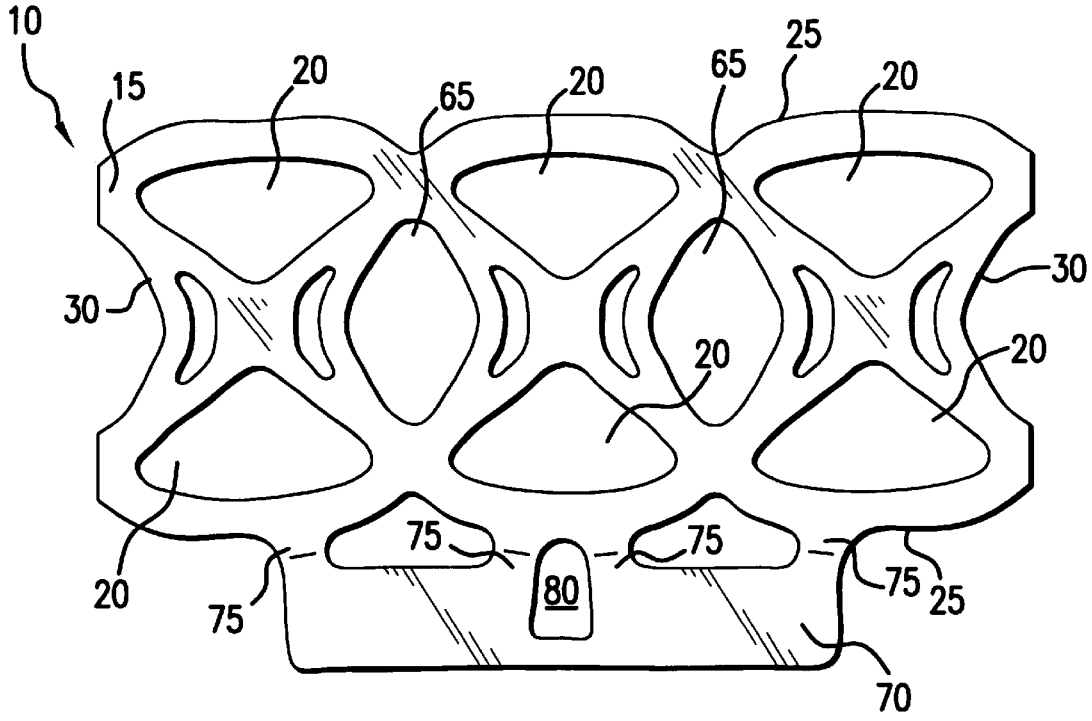
FIG. 7 is a top view of a carrier for holding six containers according to another preferred embodiment of this invention.
Figure 8:
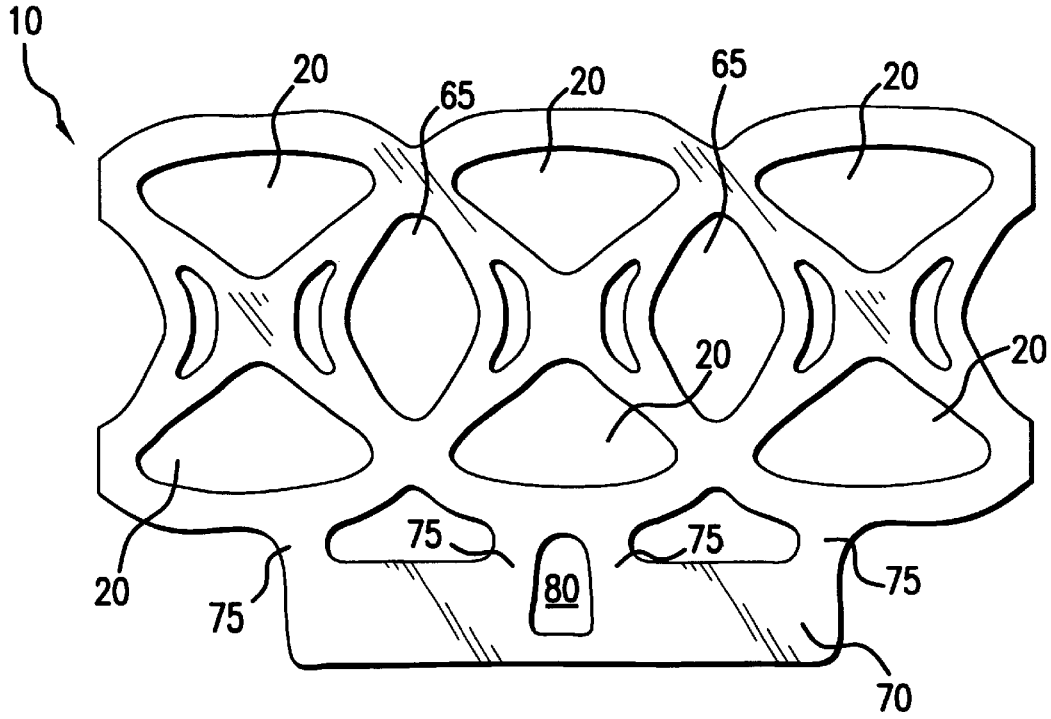
FIG. 8 is a top view of a carrier for holding six containers according to another preferred embodiment of this invention.
Figure 9:
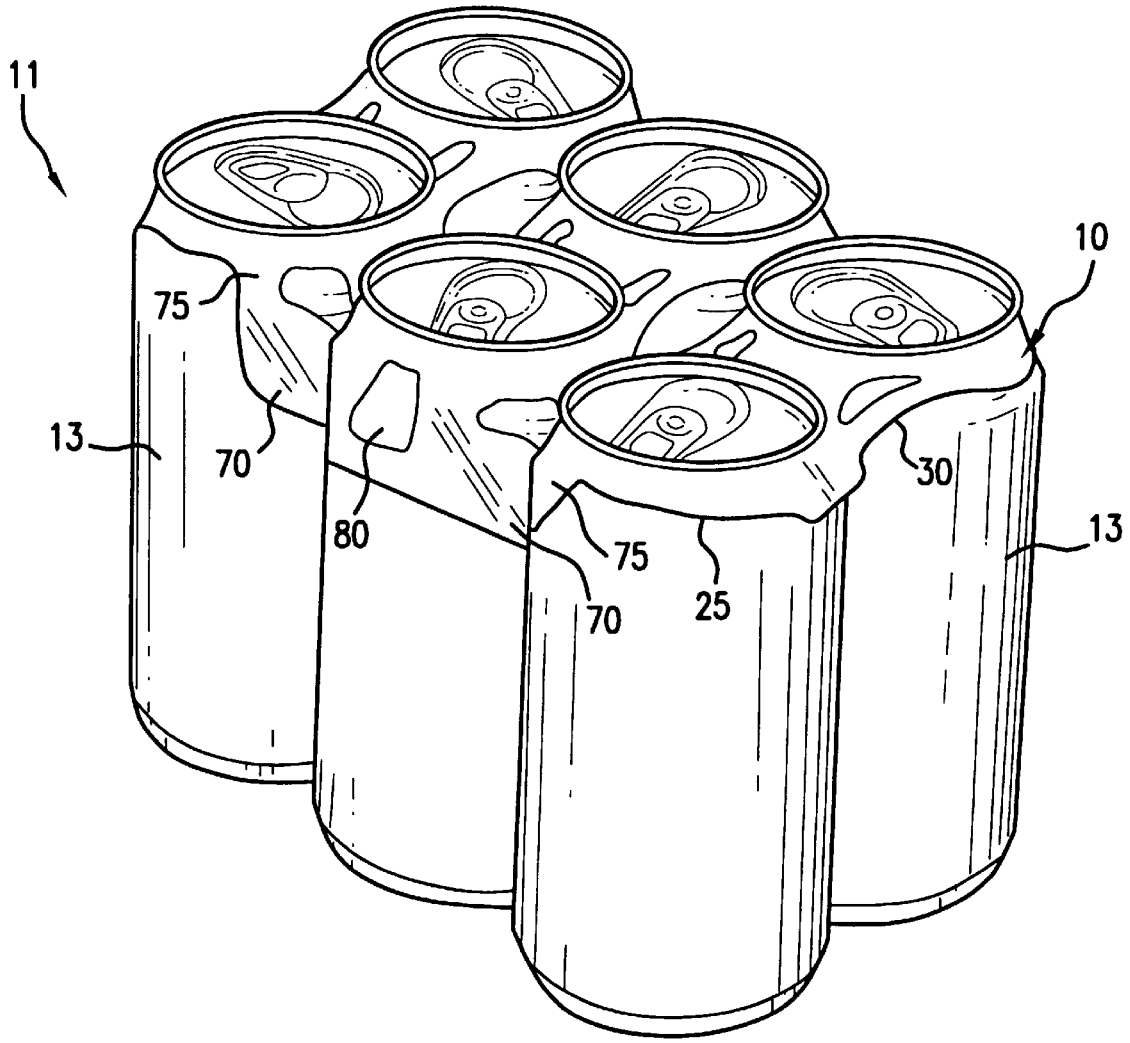
FIG. 9 is a perspective view of a package of containers using a carrier according to one preferred embodiment of this invention.

FIGS. 1–10 show carrier 10 for carrying a plurality of containers 13. Containers 13 shown in FIGS. 2 and 9 are preferably cans. Although cans are shown in FIGS. 2 and 9, bottles or any other commonly unitized container 13 may be used with carrier 10 according to this invention. Containers 13 are preferably like-sized within a single carrier 10.

Carrier 10 unitizes a plurality of containers 13 to create package 11, such as package 11 shown in FIGS. 2 and 9. Carrier 10 comprises planar sheet 15 preferably constructed from a flexible, resilient material such as plastic. In one preferred embodiment of this invention, planar sheet 15 is made from low density polyethylene. Planar sheet 15 preferably comprises two transverse edges 30 and two longitudinal edges 25.

Figure 4:
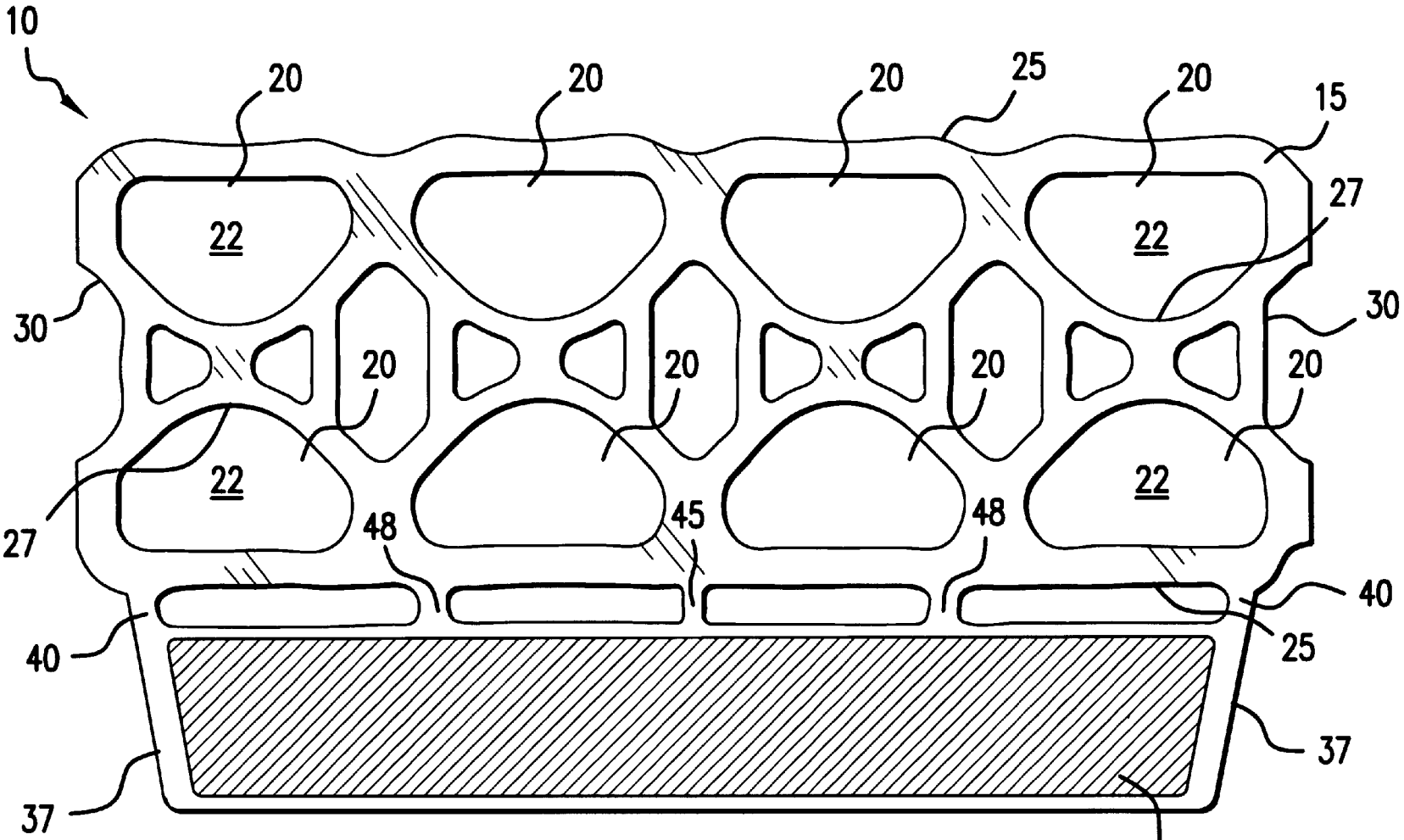
FIG. 4 is a top view of a carrier for holding eight containers according to one preferred embodiment of this invention.

Planar sheet 15 of material is preferably cut, using means known to those skilled in the art, such as a stamping die, to form a plurality of container receiving openings 20 in planar sheet 15. Except as otherwise described, container receiving openings 20 are preferably formed in a generally triangular shape having rounded corners. Preferably, six or more container receiving openings 20 are formed in planar sheet 15 in longitudinal rows and transverse ranks. Preferably, container receiving openings 20 are configured in two rows of three ranks or in two rows of four ranks. Planar sheet 15 may include other configurations of container receiving openings 20 depending on the size of package 11 desired. As shown in FIGS. 1, 2 and 5–10, in one preferred embodiment of this invention, carrier 10 comprises sheet 15 having six container receiving openings 20. As shown in FIG. 4, carrier 10 comprises sheet 15 having eight or more container receiving openings 20.

FIGS. 1–4 show carrier 10 and package 1 wherein panel 35 is formed to align in a generally flat position relative to package 1. Such a panel configuration results in a large, visible and unobstructed billboard area on a side of package 1. FIGS. 5–10 show carrier 10 and package 1 wherein panel 35 is formed to follow external contours of containers 13 within package 1. Such a panel configuration results in a large billboard area on a side of package 1 that does not protrude from package 1 thus reducing the likelihood of snagging or interfering with adjacent packages 1.

As shown in one preferred embodiment of this invention in FIGS. 1–4, container receiving openings 20 preferably include corner container receiving openings 22 and center container receiving opening 23. Container receiving openings 20 are preferably longer in a longitudinal direction than wide in a transverse direction.

Comer container receiving openings 22 are located at an intersection between an outermost row of the longitudinal rows and an outermost rank of the transverse ranks. Each carrier 10 includes four corner container receiving openings 22 located at each of four corners of the generally rectangular planar sheet 15. Comer container receiving openings 22 preferably have a reduced longitudinal length relative to container receiving openings 20 not positioned in corners of planar sheet 15. According to one preferred embodiment of this invention shown in FIG. 1, corner container receiving openings 22 include a corner at an extremity of planar sheet 15 having a larger radius than the remaining corners in container receiving openings 20. In addition, as shown in FIG. 4, corner container receiving opening 22 may include a generally straight edge along transverse edge 30 of planar sheet 15.

According to one preferred embodiment of this invention, corner container receiving opening 22 is asymmetrical about apex 27 of corner container receiving opening 22. Preferably, corner container receiving openings 22 are shortened on a side of apex 27 closest to the outward extremity of planar sheet 15. Therefore, a corner radius of each corner container receiving opening 22 at the four outward extremities of planar sheet 15 is larger than the radii of the remaining corners of container receiving openings 20.

According to one preferred embodiment of this invention shown in FIGS. 1 and 2, center container receiving opening 23 of the plurality of container receiving openings 20 is located between corner container receiving openings 22. Center container receiving opening 23 is positioned in planar sheet 15 adjacent an approximate center of longitudinal edge 25.

In part because four corner container receiving openings 22 of the plurality of container receiving openings 20 each have a shortened longitudinal length, carrier 10 preferably has a non-uniform pitch. Pitch is a dimension between a center point of adjacent container receiving openings 20 in the longitudinal rows. The pitch is traditionally important because that dimension must be maintained for conventional applicating equipment used to apply carrier 10 onto containers 13. A non-uniform pitch between longitudinally adjacent container receiving openings 20 results in non-uniform stretching of carrier 10 during application to containers 13.

In one preferred embodiment of this invention, panel 35 is integrally formed with sheet 15 and extends from longitudinal edge 25 of sheet 15. Panel 35 preferably has an overall longitudinal panel length approximately equal to an overall length of longitudinal edge 25. Panel 35 preferably accommodates, on one or both sides, UPC and proof of purchase labels, graphics, and promotional and/or other information related to contents and/or ingredients of package 11. Panel 35 is preferably generally continuous and unbroken, without cutouts or apertures, throughout its defined area.

Panel 35 preferably extends outward from longitudinal edge 25 of sheet 15. According to one preferred embodiment of this invention, two end straps 40 connect panel 35 to longitudinal edge 25 of planar sheet 15. Specifically, each end strap 40 connects panel 35 with a corner of longitudinal edge 25 of planar sheet 15. End straps 40 are preferably narrow and positioned at an extremity of the corner to influence wrap around of carrier 10 with respect to containers 13.

In addition, center strap 45 connects panel 35 with an approximate center of longitudinal edge 25 of planar sheet 15. Center container receiving opening 23 of the plurality of container receiving openings is positioned 20 in planar sheet 15 directly adjacent center strap 45. Planar sheet 15 immediately adjacent center container receiving opening 23 includes depression 50 that extends toward center strap 45.

End straps 40 and center strap 45 are preferably formed of sufficient size and shape to form a solid connection with planar sheet 15. End straps 40 and center strap 45 additionally assist in maintaining panel 35 in a flat position with respect to package 11 to increase visibility and promotional area of carrier 10. A width of center strap 45 is preferably optimized to maintain such a flat position. Preferably, center strap 45 is wider than end straps 40.

As shown in FIGS. 1, 2 and 4, panel 35 is preferably tapered along transverse panel edges 37. Panel 35 preferably extends longitudinally for a length approximately equal to an entire longitudinal length of planar sheet 15. Panel preferably additionally extends in a transverse direction for a height approximately equal to a height of container 13.

Figure 3:
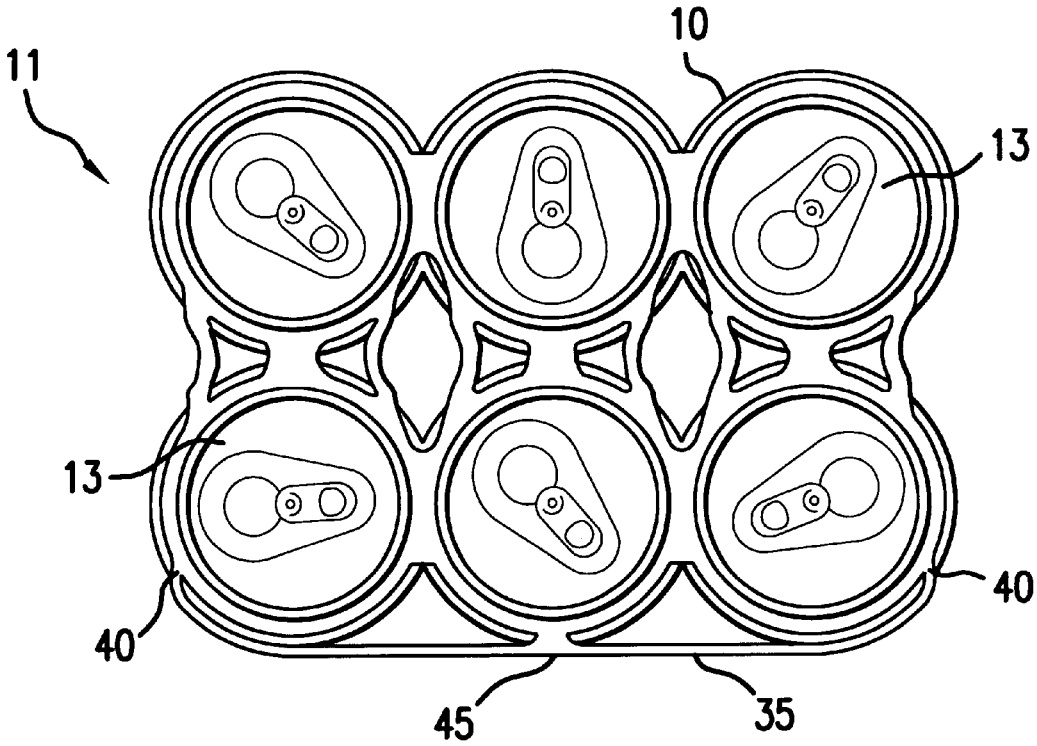
FIG. 3 is a top view of the package shown in FIG. 2.

As shown in FIGS. 2 and 3, container 13 is positioned in each container receiving opening 20 to form package 11. According to one preferred embodiment of this invention, panel 35 is preferably flat and parallel with respect to containers 13 and prominent with respect to package 11. If panel 35 is curled or folded in a perpendicular position with respect to package 11, then advertising or other material positioned on panel will not be legible to a consumer. In addition, panel 35 that protrudes with respect to package 11 will create difficulties in packaging, handling and stacking packages 11 because of interference between panels 35 of adjacent packages 11 and between panel 35 and packaging equipment.

Several of the above described features of carrier 10 facilitate a flat and prominent panel 35 with respect to package 11. For example, the generally straight edges formed by portions of container receiving openings 20 adjacent longitudinal edge 25 urges panel 35 into a generally flat position with respect to containers 13 in package 11. In addition, the non-uniform pitch between longitudinally adjacent container receiving openings 20 also aids in the relative flatness of panel 35 with respect to package 11 because of non-uniform stretching of carrier 10 during application to containers 13.

The attachment points at end straps 40 and center strap 45 also create a flat panel 35 with respect to package 11. A relatively narrow dimension of end strap 40 and the position of end strap 40 at each extremity of package 11 is important for reducing bunching and curling of panel 35 by helping to wrap panel 35 slightly around containers 13 at the ends of package 11. The result of a tight unitized block of containers 13 is a flat panel 35 with respect to package 11.

Depression 50 in planar sheet 15 adjacent center container receiving opening 23 also creates a tighter unitized block of containers 13 within package 11. Depression 50 also assists carrier 10 in retaining containers 13 underneath each respective chime.

As shown in a preferred embodiment of this invention in FIGS. 5–10, carrier 10 comprises planar sheet 15 of a plastic material as discussed above. A plurality of generally triangular container receiving openings 20 are preferably arranged in planar sheet 15 in two longitudinal rows.

A plurality of diamond-shaped openings 65 are arranged in a longitudinal row along a center of planar sheet 15 between the two longitudinal rows of container receiving openings 20. As shown in FIGS. 5–10, diamond-shaped openings 65 are preferably positioned so that a single diamond-shaped opening 65 is positioned central to four container receiving openings 20.

Contour panel 70 extends from longitudinal edge 25 of planar sheet 15. Contour panel 70 preferably comprises a panel width less than a length of longitudinal edge 25 of planar sheet 15. Contour panel 70 additionally comprises a height preferably less than half a transverse width of planar sheet 15.

A plurality of panel straps 75 preferably extend from longitudinal edge 25 to connect contour panel 70 with planar sheet 15. According to one preferred embodiment of this invention, four panel straps 75 extend from longitudinal edge 25 of planar sheet 15 to connect contour panel 70. Two panel straps 75 preferably extend from a center portion of longitudinal edge 25 of planar sheet 15 and two panel straps 75 preferably extend from outer portions of longitudinal edge 25 of planar sheet 15.

According to a preferred embodiment of this invention, each panel strap 75 extending from an outer portion of longitudinal edge 25 extends from an attachment point at, or inside, a transverse center line of outer container receiving openings 20. These attachment points, shown in FIGS. 9 and 10, urge contour panel 70 into contoured engagement with containers 13 in package 11. The remaining two panel straps 75 preferably extend from a portion of planar sheet 15 immediately adjacent a center container receiving opening 20.

Figure 5:
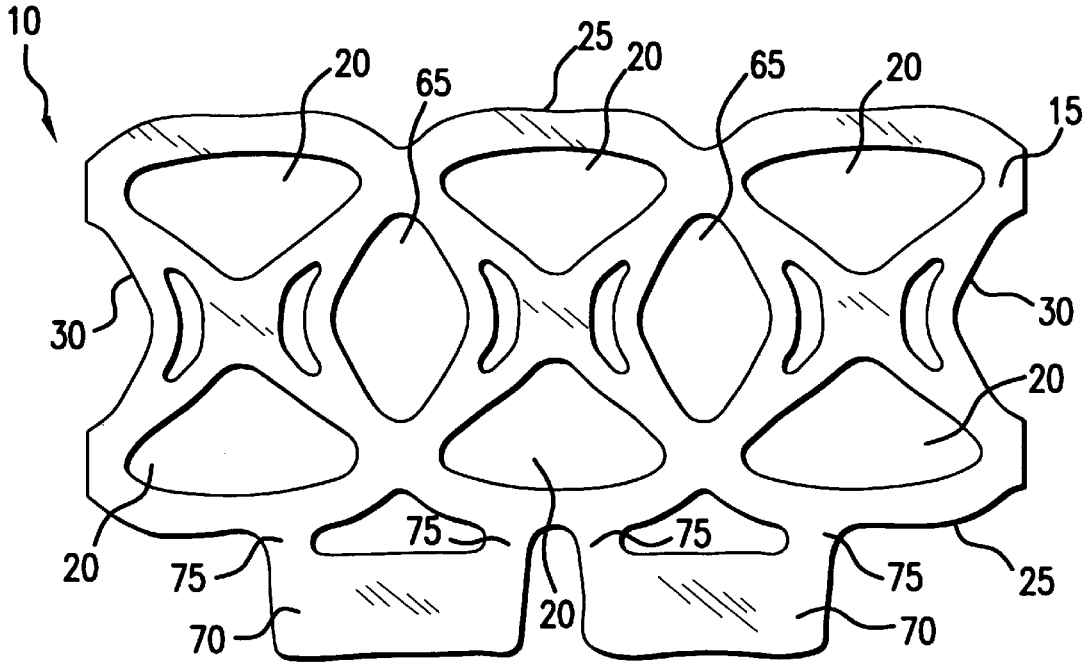
FIG. 5 is a top view of a carrier for holding six containers according to another preferred embodiment of this invention.
Figure 6:
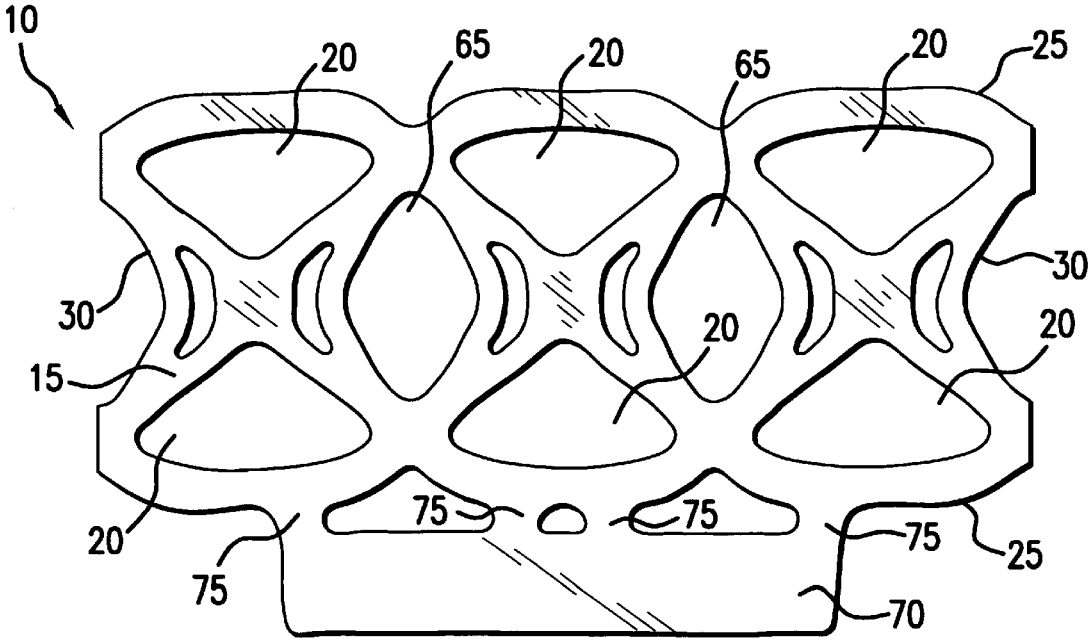
FIG. 6 is a top view of a carrier for holding six containers according to one preferred embodiment of this invention.

According to a preferred embodiment of this invention shown in FIG. 5, an additional contour panel 70 extends from longitudinal edge 25 of planar sheet 15. As shown in FIG. 5, each contour panel 70 extends from common longitudinal edge 25 and each is connected with respect to planar sheet 15 with two panel straps 75.

According to another preferred embodiment of this invention, shown in FIGS. 7 and 8, contour panel 70 further comprises center cutout 80. Center cutout 80 assists contour panel with adhering to contour of package 11 in an assembled carrier 10.

Figure 10:
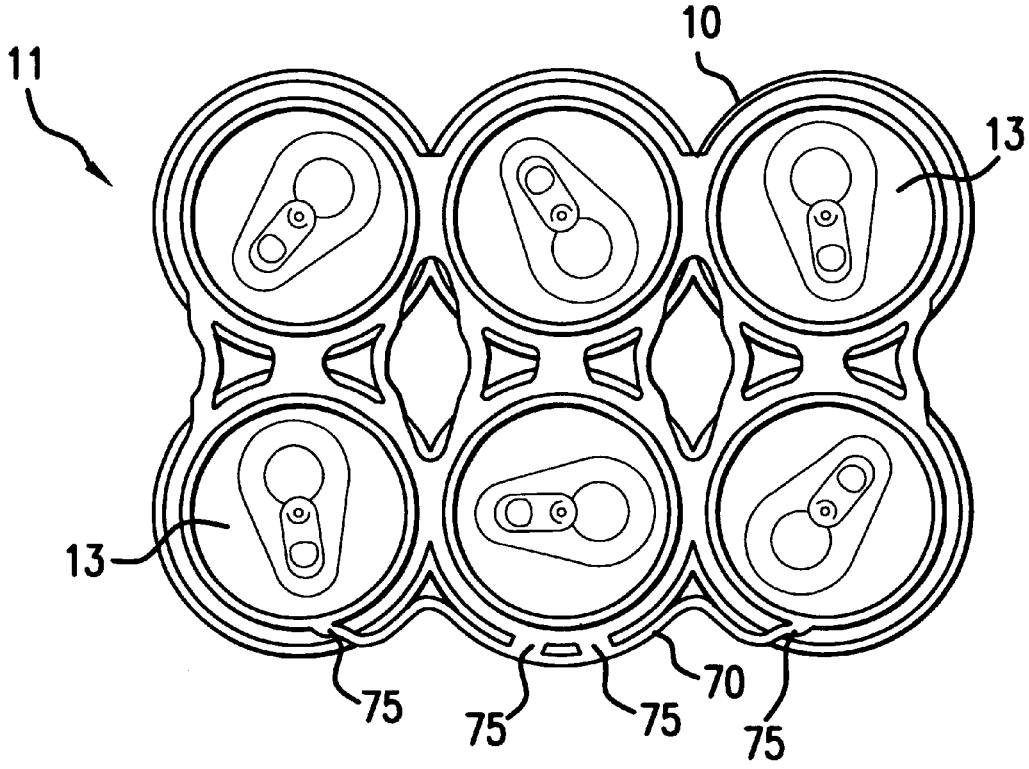
FIG. 10 is a top view of the package shown in FIG. 9.

In package 11 of a plurality of containers 13 as shown in FIGS. 9 and 10, each container receiving opening 20 of the plurality of container receiving openings 20 engages container 13. Diamond-shaped openings 65 preferably form space within central regions of package 11 to create a handle.

Contour panel 70 according to this preferred embodiment of the invention, extends from longitudinal edge 25 of planar sheet 15 and conforms with an external contour of package 11. Such a contoured engagement decreases the potential for protruding sections of carrier 10 to interfere or engage with adjacent packages 11 or other such goods.

Several features enable contour panel 70 to follow the external contour of package 11. A height and length of contour panel 70 are reduced relative to carrier 10 that, in part, enables contour panel 70 to follow the external contour of package 11. In addition, multiple panel straps 75 connecting planar sheet 15 at predetermined intervals along longitudinal edge 25 assist in retaining contour panel 70 against the external contour of package 11. Specifically, two panel straps 75 connecting longitudinal edge 25 directly adjacent a center rank container receiving opening 20 and one panel strap 75 connecting longitudinal edge 25 directly adjacent each end rank container receiving opening 20.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

We claim:

1. A carrier for carrying a plurality of containers, the carrier comprising:

a planar sheet of a plastic material, the sheet having a plurality of container receiving openings arranged in longitudinal rows and transverse ranks, the plurality of container receiving openings each having a generally straight edge formed in an edge nearest the longitudinal edges of the planar sheet;

a panel extending from a longitudinal edge of the planar sheet;

two end straps, each end strap connecting the panel with a corner of the longitudinal edge of the planar sheet;

a center strap connecting the panel with an approximate center of the longitudinal edge of the planar sheet; and a center container receiving opening of the plurality of container receiving openings positioned in the planar sheet directly adjacent the center strap, the planar sheet adjacent the center receiving opening having a depression extending toward the center strap.

2. The carrier of claim 1 wherein corner container receiving openings of the plurality of container receiving openings have a shortened longitudinal length relative to the center container receiving opening.

3. The carrier of claim 2 wherein the corner container receiving opening is asymmetrical about an apex of the corner container receiving opening.

4. The carrier of claim 3 wherein the corner container receiving opening is shortened on an extremity side of the apex.

5. The carrier of claim 1 wherein the panel is tapered along transverse edges.

6. The carrier of claim 1 further comprising a non-uniform pitch between longitudinally adjacent container receiving openings.

7. The carrier of claim 1 wherein the four corner container receiving openings have generally straight edges along a transverse edge of the planar sheet.

8. A package for carrying a plurality of containers, the package comprising:

a planar sheet of a plastic material, the sheet having a plurality of container receiving openings arranged in longitudinal rows and transverse ranks, the plurality of container receiving openings each having a generally straight edge along the longitudinal edges of the planar sheet;

a container of the plurality of containers positioned in each container receiving opening of the plurality of container receiving openings;

a panel extending from a longitudinal edge of the planar sheet, the panel connected with end straps at two ends of the longitudinal edge of the planar sheet approximate to each extremity of the package;

a center strap connecting the planar sheet to the panel at an approximate center of the longitudinal edge; and four corner container receiving openings of the plurality of container receiving openings each having a shortened longitudinal length so that in the package the panel extends from the longitudinal edge of the planar sheet and remains flat with respect to the package.

9. The carrier of claim 8 further comprising a center container receiving opening of the plurality of container receiving openings positioned in the planar sheet directly adjacent the center strap, the center receiving opening having a depression extending toward the center strap.

10. The carrier of claim 8 further comprising a non-uniform pitch between longitudinally adjacent container receiving openings.

11. A carrier for carrying a plurality of containers, the carrier comprising:

a planar sheet of a plastic material having a plurality of container receiving openings arranged in longitudinal rows and transverse ranks;

a panel extending from a longitudinal edge of the planar sheet;

two end straps, each end strap connecting the panel with a corner of the longitudinal edge of the planar sheet;

a center strap connecting the panel with an approximate center of the longitudinal edge of the planar sheet; and two intermediate straps extending from the longitudinal edge of the planar sheet to the panel, each intermediate strap spaced approximately between the center strap and one of the two end straps.

12. The carrier of claim 11 wherein the four corner container receiving openings have generally straight edges along a transverse edge of the planar sheet.

13. The carrier of claim 11 wherein the plurality of container receiving openings each have a generally straight edge along the longitudinal edge s of the planar sheet.

14. A carrier for carrying a plurality of containers, the carrier comprising:

a planar sheet of a plastic material, the sheet having a plurality of container receiving openings arranged in longitudinal rows and transverse ranks, the plurality of container receiving openings each having a generally straight edge along the longitudinal edges of the planar sheet;

a panel extending from a longitudinal edge of the planar sheet;

two end straps, each end strap connecting the panel with a corner of the longitudinal edge of the planar sheet at a location both transversely and longitudinally beyond a nearest respective container receiving opening;

a center strap connecting the panel with an approximate center of the longitudinal edge of the planar sheet; and a center container receiving opening of the plurality of container receiving openings positioned in the planar sheet directly adjacent the center strap, the planar sheet adjacent the center container receiving opening having a depression extending toward the center strap.

15. A carrier for carrying a plurality of containers, the carrier comprising:

a planar sheet of a plastic material, the sheet having a plurality of container receiving openings arranged in longitudinal rows and transverse ranks, the plurality of container receiving openings each having a generally straight edge formed in an edge nearest the longitudinal edges of the planar sheet;

a panel extending from a longitudinal edge of the planar sheet;

two end straps, each end strap connecting the panel with a corner of the longitudinal edge of the planar sheet at a location both tranversely and longitudinally beyond a nearest respective container receiving opening; and a center strap connecting the panel with an approximate center of the longitudinal edge of the planar sheet.

* * * * *